US008357884B1

(12) United States Patent
Ethridge et al.

(10) Patent No.: US 8,357,884 B1
(45) Date of Patent: Jan. 22, 2013

(54) SYSTEM OF EXTRACTION OF VOLATILES FROM SOIL USING MICROWAVE PROCESSES

(75) Inventors: Edwin C. Ethridge, Huntsville, AL (US); William F. Kaukler, Huntsville, AL (US)

(73) Assignee: The United States of America as represented by the Administrator of the National Aeronautics and Space Administration, Washington, DC (US)

( * ) Notice: Subject to any disclaimer, the term of this patent is extended or adjusted under 35 U.S.C. 154(b) by 276 days.

(21) Appl. No.: 12/839,848

(22) Filed: Jul. 20, 2010

(51) Int. Cl.
*H05B 6/64* (2006.01)

(52) U.S. Cl. ..... 219/679

(58) Field of Classification Search ..... 219/679
See application file for complete search history.

(56) References Cited

U.S. PATENT DOCUMENTS

| | | | | |
|---|---|---|---|---|
| 4,571,473 | A * | 2/1986 | Wyslouzil et al. | 219/691 |
| 5,076,727 | A * | 12/1991 | Johnson et al. | 405/128.35 |
| 5,205,364 | A * | 4/1993 | Juergens et al. | 175/38 |
| 5,318,116 | A * | 6/1994 | Vinegar et al. | 166/60 |
| 5,509,956 | A | 4/1996 | Opperman et al. | |
| 6,086,830 | A | 7/2000 | Kartchner | |
| 6,437,304 | B2 | 8/2002 | Ushijima et al. | |
| 6,603,422 | B2 | 8/2003 | Wright | |
| 7,325,511 | B2 | 2/2008 | Goto et al. | |
| 2008/0003133 | A1 | 1/2008 | Taylor et al. | |
| 2011/0077800 | A1 * | 3/2011 | Palmer et al. | 701/2 |

* cited by examiner

*Primary Examiner* — Thao Le
*Assistant Examiner* — Matthew Gordon
(74) *Attorney, Agent, or Firm* — Absolute Technology Law Group; James J. McGroary

(57) ABSTRACT

A device for the extraction and collection of volatiles from soil or planetary regolith. The device utilizes core drilled holes to gain access to underlying volatiles below the surface. Microwave energy beamed into the holes penetrates through the soil or regolith to heat it, and thereby produces vapor by sublimation. The device confines and transports volatiles to a cold trap for collection.

19 Claims, 3 Drawing Sheets

SYSTEM OF EXTRACTION OF VOLATILES FROM SOIL USING MICROWAVE PROCESSES

STATEMENT REGARDING FEDERALLY SPONSORED RESEARCH OR DEVELOPMENT

The invention described herein was made in performance of work under a NASA contract by an employee of the United States Government and is subject to the provisions of Public Law 96-517 (35 U.S.C. §202) and may be manufactured and used by or for the Government for governmental purposes without the payment of any royalties thereon or therefore. In accordance with 35 U.S.C. §2020, the contractor elected not to retain title.

BACKGROUND

Water is a valuable resource, particularly for space exploration, and it is obviously necessary for human habitation. Extraction of water from planetary bodies is desirable for human life support, for radiation protection shielding and as propellant. Water and a number of other useful volatiles may exist on the moon and other planetary bodies. Water can easily be electrolyzed (with solar or nuclear energy) into hydrogen and oxygen. This hydrogen and oxygen can be stored and subsequently used with fuel cells for electrical energy or as a propulsion fuel. Water is present in comets as well as on the surface of planetary bodies (e.g., Mars, the moon). This water can be extracted for utilization during space exploration activities.

Simple and cost-effective extraction of water and subsequent electrolyzing would enable the development of a fuel depot in space, on the moon, or on other planetary bodies. The resulting fuel would have commercial, military, and NASA uses. The efficient extraction of water or other volatiles would permit the return of spacecrafts from planetary bodies without having to launch the return fuel from Earth.

Volatile species are often found below the soil surface, with the highest concentration often a distance from the surface. Applying microwaves to the surface results in the greatest heating at the surface and spreads (with decreasing heating effect) deeper into the surface as the microwave energy is attenuated in the soil. The lunar surface has a low thermal conductivity, which strongly disfavors traditional methods of heating. Microwave heating of regolith is faster and more efficient than other heating methods due to the ability to couple energy into the subsurface volume.

In addition, microwaves can penetrate into the soil permitting water removal from deep below the surface with collection above the surface. This permits the extraction of water or other volatiles without the need to dig or excavate the surface.

The desired wavelength of the microwaves may be adjusted for the electromagnetic properties of the regolith (e.g., lunar, Martian, Earth, asteroid).

The delivery of microwave energy into soil from the earth's surface is known. Microwave heating, particularly of lunar regolith, is potentially faster and more efficient than other heating methods due to the very low thermal conductivity of lunar regolith. This is especially true in the vacuum on the moon and in the low partial pressure of Mars. For example, U.S. Pat. No. 4,571,473 (Wyslouzil '473) describes a microwave applicator for thawing frozen ground using a coaxial line to deliver microwaves into the ground.

U.S. application Ser. No. 11/477,253 (Taylor '253) describes an apparatus and method for in-situ microwave consolidation of planetary materials containing nano-sized metallic iron particles to sinter and/or melt the particles for use in roadways and other construction materials. Taylor '253 uses a generator, waveguide, and funnel to generate and direct microwave energy from a paver to a particulate surface under the paver to heat and consolidate the lunar soil particles into a suitable solid mass.

The method taught by Taylor '253 relies on the presence of iron in nanophase metallic iron-containing particles to generate the heat necessary to sinter and/or melt the particles. However, the precise quantity and location of nanophase iron or other metals in lunar regolith is unknown; therefore, is it undesirable to rely on an apparatus or method that requires iron.

It is desirable to have a device which utilizes microwaves to extract and collect volatiles from regolith.

It is desirable to have a device for extracting and collecting volatiles from regolith that does not require digging, drilling, excavating, or removal of overlying soil.

It is desirable to have a system for efficient and cost-effective extraction and collection of volatiles from regolith for use or further processing.

It is desirable to have a device for heating regolith which does not rely on the presence of iron.

It is desirable to have a device for extracting and collecting volatiles from regolith that can be adjusted for regolith having various electromagnetic properties.

It is desirable to have a device capable of extracting and collecting volatiles without having to thaw the regolith.

It is desirable to have a device for extracting and collecting volatiles that heats soil to a significant depth without relying on thermal conduction, convection, or thermal radiation.

It is desirable to have structurally integrated components, which minimize the number of parts that must be manufactured and tested.

SUMMARY OF THE INVENTION

The present invention is a device and system utilizing microwave energy for extraction and collection of volatile chemicals from regolith. The device is comprised of a microwave generator, a microwave delivery component, a subliming boring component, a collection chamber, and a remote sensor for detecting water vapor flow.

While this application describes systems and methods in relation to extraterrestrial bodies, it should be understood that the system and methods may have additional applications that would be apparent to one skilled in the art, e.g., to remove contaminants in-situ from contaminated soil on Earth.

GLOSSARY

Figure 1:
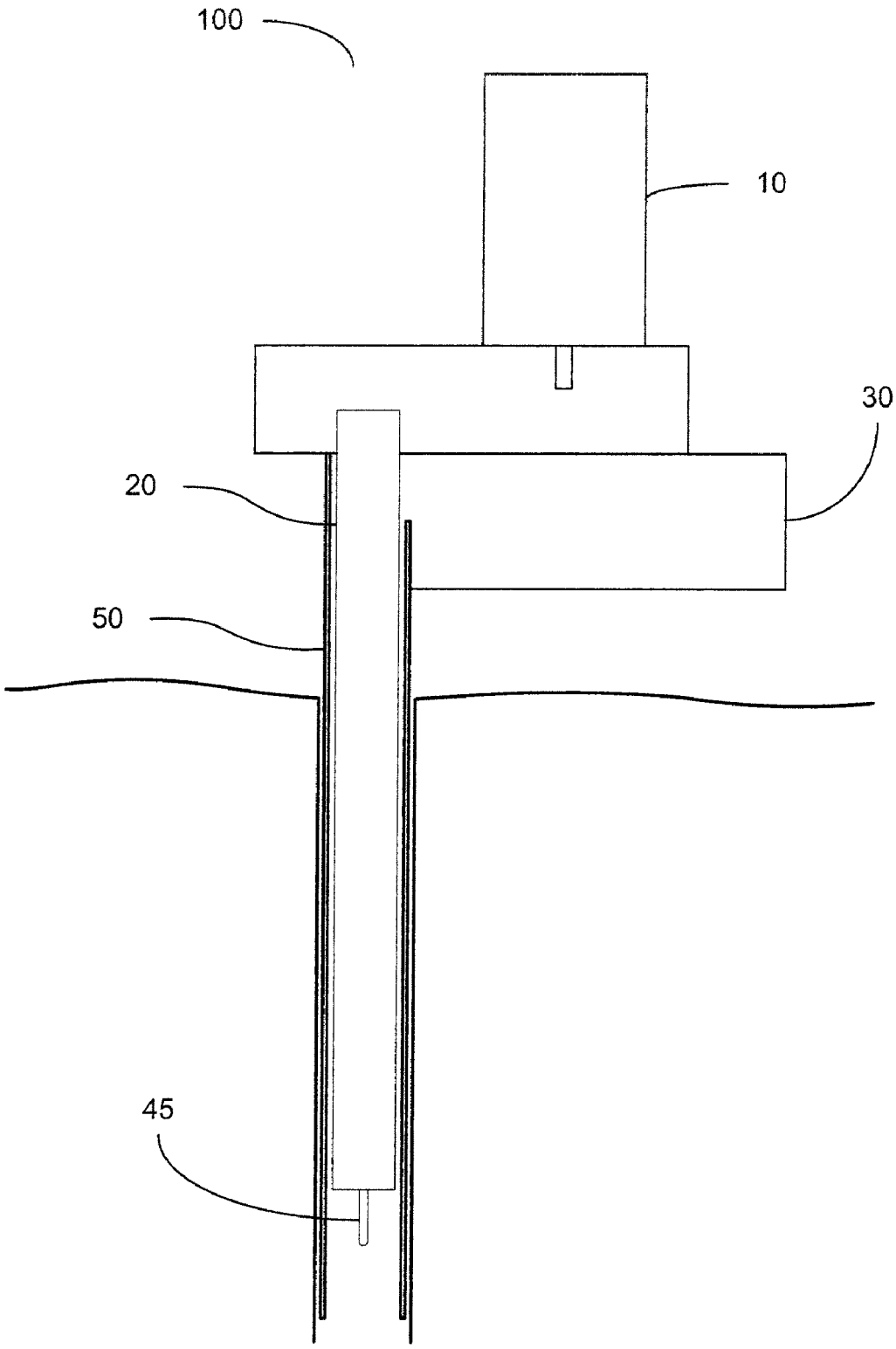
FIG. 1 illustrates a side view of an exemplary embodiment of a volatile extraction and collection device.

As used herein, the term "boring component" is a component structurally adapted to produce a hole in the planetary body surface.

As used herein, the term "coaxial cable" refers to a cable consisting of a conductive outer metal tube that encloses and is insulated from a central conducting core, and which is used primarily for the transmission of high-frequency signals.

As used herein, the term "cold trap" refers to a device that condenses all vapors except the permanent gasses into a liquid or solid in vacuum applications (e.g., a tube whose walls are cooled to condense vapors passing through it).

As used herein, the term "dielectric" refers to a substance that is a poor conductor of electricity (particularly a substance with electrical conductivity of less than a millionth ($10^{-6}$) of a Siemens), but an efficient supporter of electrostatic field.

As used herein, the term "multi-function" means a single structural component which serves two or more of the following functions: a boring component, microwave delivery component, cold trap, volatile transport or any other function of a component of a device for extraction of volatiles from soil using microwave processes.

As used herein, the term "microwave" refers to an electromagnetic wave whose wavelength ranges from 1 millimeter to 1 meter with frequencies between 300 MHz (0.3 GHz) and 300 GHz.

As used herein, the term "microwave delivery component" refers to a device in operable communication with a microwave source and capable of conveying microwave energy in a constrained manner from the microwave source and selectively delivering the microwave energy to a targeted area.

As used herein, the term "microwave source" or "microwave generator" refers to a device capable of selectively producing microwave energy.

As used herein, the term "mobility component" refers to a component capable of transporting an apparatus on either terrestrial or extra-terrestrial soil.

As used herein, the term "regolith" refers to the layer of loose rock particles and dust that covers the bedrock of Earth (terrestrial) and extraterrestrial bodies (e.g., lunar, Martian, asteroid).

As used herein, the term "remote control component" refers to a component capable of controlling the position of a device or apparatus in either a terrestrial or an extra-terrestrial location from a distance.

As used herein, the term "remote microwave source" refers to a microwave source that is not integral with a microwave delivery component and may be located and in operable communication with microwave delivery component at a distance from microwave delivery component.

As used herein, the term "soil" refers to the top layer of the Earth's surface, consisting of rock and mineral particles mixed with organic matter.

As used herein, the term "sublimation vessel" or "collection chamber" refers to a vessel in which a substance is converted directly from a solid to a gas or from a gas to a solid without an intermediate liquid phase.

As used herein, the term "subliming component" refers to a component capable of delivering the microwave energy to the soil or regolith that causes sublimation of the volatile species.

As used herein, the term "volatile" means readily evaporating or vaporizable at a relatively low temperature.

As used herein, the term "volatile sensing device" refers to an apparatus capable of detecting the presence of a volatile chemical in a planetary regolith.

As used herein, the term "waveguide" refers to a hollow metal conductor which is used as a path to convey microwave energy along its length or a transmission line consisting of solid rod of conductor surrounded by dielectric which is then surrounded by a metallic ground.

DETAILED DESCRIPTION OF INVENTION

For the purpose of promoting an understanding of the present invention, references are made in the text to exemplary embodiments of a system for extracting volatiles from soil using microwave processes, only some of which are described herein. It should be understood that no limitations on the scope of the invention are intended by describing these exemplary embodiments. One of ordinary skill in the art will readily appreciate that alternate but functionally equivalent materials, components, and arrangements may be used. The inclusion of additional elements may be deemed readily apparent and obvious to one of ordinary skill in the art. Specific elements disclosed herein are not to be interpreted as limiting, but rather as a basis for the claims and as a representative basis for teaching one of ordinary skill in the art to employ the present invention.

It should be understood that the drawings are not necessarily to scale; instead, emphasis has been placed upon illustrating the principles of the invention. In addition, in the embodiments depicted herein, like reference numerals in the various drawings refer to identical or near identical structural elements.

Moreover, the terms "substantially" or "approximately" as used herein may be applied to modify any quantitative representation that could permissibly vary without resulting in a change in the basic function to which it is related.

FIG. 1 illustrates a side view of an exemplary embodiment of volatile extraction and collection device 100 for extraction of volatiles from soil using microwaves. In the embodiment shown, volatile extraction and collection device 100 is comprised of microwave source 10, microwave delivery component 20, collection chamber 30, boring component 50, and wave dipole antenna 45.

In the embodiment shown, boring component 50 is a singular component which serves the multiple functions of both microwave delivery (a waveguide) and volatile transport.

The embodiment shown in FIG. 1 further includes microwave delivery coaxial device 20. (Other embodiments may include other functionally equivalent microwave delivery structures known in the art such as a hollow tubular or non-tubular structure.)

In the embodiment shown, boring component 50 bores a hole in the soil or regolith to gain access to underlying water or volatiles contained in soil below the surface. Depending on the optimal frequency, boring component 50 may serve as the hollow microwave waveguide or a coaxial microwave delivery component 20 and is inserted into the resulting bore hole. In various embodiments, the length of boring component 50 may be adjustable. For example, boring component 50 may be telescoping. In still other embodiments, boring component 50 can rotate to "drill" through the regolith to produce a hollow borehole.

In an exemplary embodiment, boring component 50 receives energy from microwave delivery component 20 which heats and loosens the regolith allowing boring component 50 to better penetrate regolith hardened by the presence of ice. The energy heats the regolith from the inside out, creating a gas pressure. As gas flows through the regolith, it lifts the regolith particles allowing boring component 50 to move through the regolith. In an exemplary embodiment, boring component 50 also confines the gas containing regolith particles as it flows through the regolith. In another embodiment, gas pressure is applied directly below the surface.

In the exemplary embodiment shown, microwave delivery component 20 is operatively coupled to microwave source 10 and is adapted to convey the microwave energy emitted from microwave source 10 into the soil at the bottom of microwave delivery component 20. The emitted microwaves heat the soil and water/ice, producing water vapor by sublimation. The water vapor rises through hollow microwave waveguide and is collected by collection chamber 30, preventing water vapor from escaping.

In various embodiments, hollow microwave waveguide may be completely sealed so water vapor and other gasses are properly contained. Vapor can be extracted and collected from the soil without thawing the soil, allowing vapor to be extracted and collected at temperatures below the freezing temperature of water. For example, in an exemplary embodiment, vapor can be extracted and collected at soil temperatures below 0° C.

In the embodiment shown, microwave delivery component 20 is a coaxial cable, which is capable of efficiently delivering energy to the desired target. Microwave delivery component 20 is adapted to deliver microwave energy proportionate to the electromagnetic characteristics of the soil or regolith (e.g., lunar regolith). Microwave delivery component 20 may reach any desired depth. In the embodiment shown, the diameter of bore holes are slightly larger than the diameter of the coaxial cable to provide a pathway for the water vapor to reach collection chamber 30.

In the exemplary embodiment shown, microwave delivery component 20 (coaxial cable) is dipole antenna 45 which in the embodiment is a microwave emitting device (a ¼ wave dipole antenna). Microwaves transmit outward from wave dipole antenna 45. In the embodiment shown, microwaves radiate circularly or spherically from ¼ wave dipole antenna 45.

In another embodiment, microwave delivery component 20 is a multi-function hollow circular waveguide, which is capable of efficiently delivering energy to the desired target. In various embodiments, microwave delivery component 20 may be adapted to function as primary wave guide and serve the function of confining any released gasses. Microwave delivery component 20 may also serve the additional function of drilling structure.

It is contemplated that a structurally integrated waveguide will minimize the number of parts that must be manufactured and tested. An advantage of this structural integration is to reduce both project costs and the object mass.

The dimensions of microwave delivery component 20 correspond to the wavelength of the microwaves emitted by microwave source 10. In various embodiments, a hollow waveguide structure may also be used to transfer vapor to a collection chamber located on a rover vehicle or other remote transportation device.

Other embodiments, microwave delivery component 20 may be used as a waveguide, which is less sensitive to the specific diameter of the bore hole, permitting small diameter bore holes and allowing microwaves of longer wavelengths to be transmitted without varying the size of the bore hole.

In the exemplary embodiment, collection chamber 30 recovers the extracted volatile vapor. In the embodiment shown, collection chamber 30 is a cold trap and the volatile water collects on the chilled surface of collection chamber 30 as it percolates from the regolith and migrates through confining structure 20 to cold trap 30.

In an exemplary embodiment, the microwaves generated by microwave source 10 have a wavelength ranging from 0.5 to 30 GHz. Microwaves with a wavelength of 0.5 GHz will penetrate deeper into the regolith than 30 GHz microwaves, which are used for shallower penetration.

While it is known that most lunar water will be at the poles, the precise amount of water in a specific location may be unknown. Boring component 50 may also be adapted to sense the quantity of water being drilled and/or the availability of water. Still other embodiments may include a volatility sensor which will detect the volatile species flow rate. When the flow rate drops below a set level, it indicates that the regolith is depleted of volatile species.

The structural configuration of the apparatus illustrated in FIG. 1 contemplates that multiple synergistic processes, structural integration and multi-functioning of numerous integrated components makes this approach highly efficient. The time, energy, and equipment for excavation and transport of the regolith is not required, and potential damage from raised dust is greatly minimized. Microwave energy delivered by microwave delivery component 20 can penetrate several feet into the soil past the thin, waterless surface layer. Surface absorption reduces efficient water extraction by heating material that likely contains little water and prevents energy from reaching the furthest depths. To extract water, microwaves need to pass through the surface with less absorption at the surface.

Volatile extraction and collection device 100 may also be used to extract other valuable volatiles from the regolith, such as solar wind products.

In various embodiments of volatile extraction and collection device 100, it is contemplated that the user may direct the microwave frequency energy of a microwave beam into the lunar soil. Heating occurs by dielectric absorption into regolith particles and trapped water will be released depending on the dielectric properties, temperature, and microwave wavelength.

Volatile extraction and collection device 100 overcomes the problem known in the art that ice does not couple well with microwave energy. The heating occurs by the microwave coupling to the soil which heats the ice by conduction.

When the soil is heated by volatile extraction and collection device 100, heat flows into the water/ice, heating the water/ice and causing the water/ice to sublime directly to water vapor, once the temperature gets above a critical point.

In various embodiments, volatile extraction and collection device 100 gas pressure between the grains of regolith is much higher than at the surface. The structural design of volatile extraction and collection device 100 may be adapted to take into account that magnitude of this pressure will change dramatically with local temperature. As regolith grains are warmed, it is contemplated that the trapped ice should sublime, but both the local pressure and temperature will determine when the vapor is released. The water vapor will migrate through the soil from the high vapor pressure regions in the soil, through the system, to the cold trap at ambient low pressure (or vacuum). While these interrelated phenomena make prediction of yield difficult, it is certain that water vapor will be released.

In one embodiment, microwave source 10 may remain on a remote delivery device, e.g., a rover vehicle, with microwave delivery component 20 delivering the energy to the desired target.

Figure 2A:
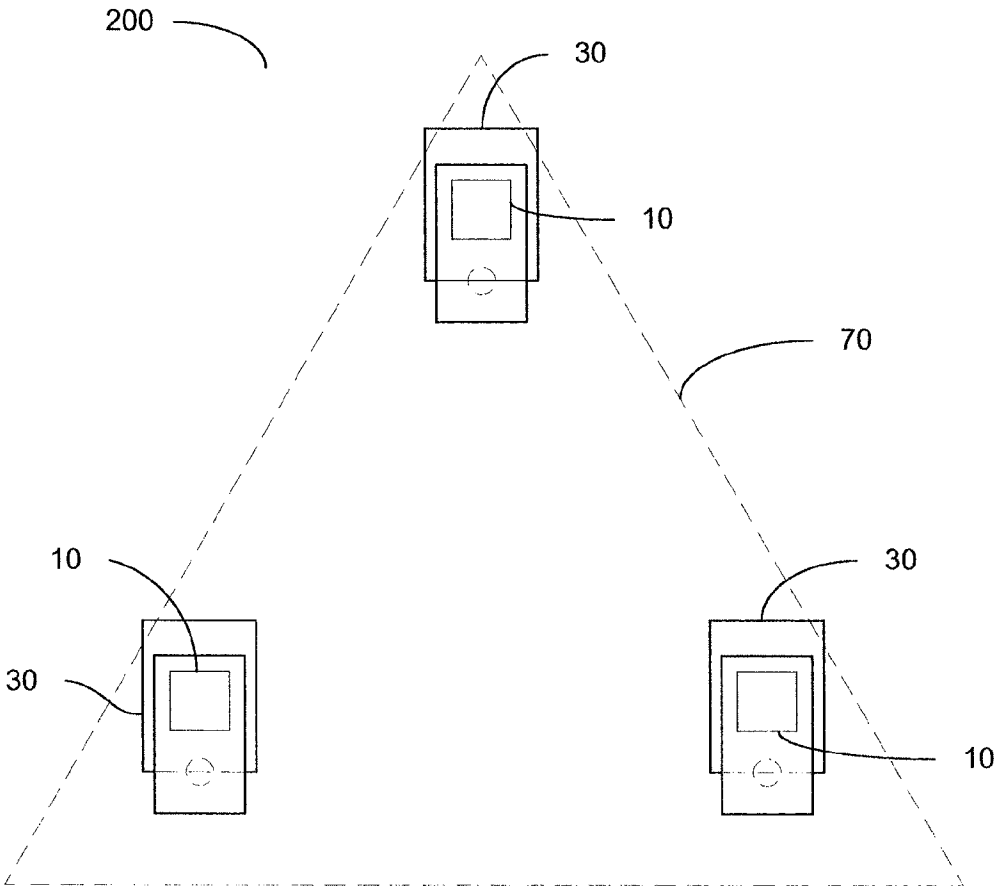
FIG. 2*a* illustrates a top view of an exemplary embodiment of a system for extracting and collecting volatiles from soil.

FIG. 2*a* illustrates a top view of an exemplary embodiment of system for extracting and collecting volatiles from soil 200. In the embodiment shown, volatile extraction and collection devices 100 are configured so that the bore holes are arranged in a triangle. Microwave sources 10 emit microwaves which heat the regolith in the region between the three bore holes. Once the region between the three bore holes is depleted, as indicated by the volatile species detector (e.g. mass spectrometer), at least one of the extraction and collection devices 100 is moved to create a new triangular region formed by the three extraction and collection devices.

Figure 2B:
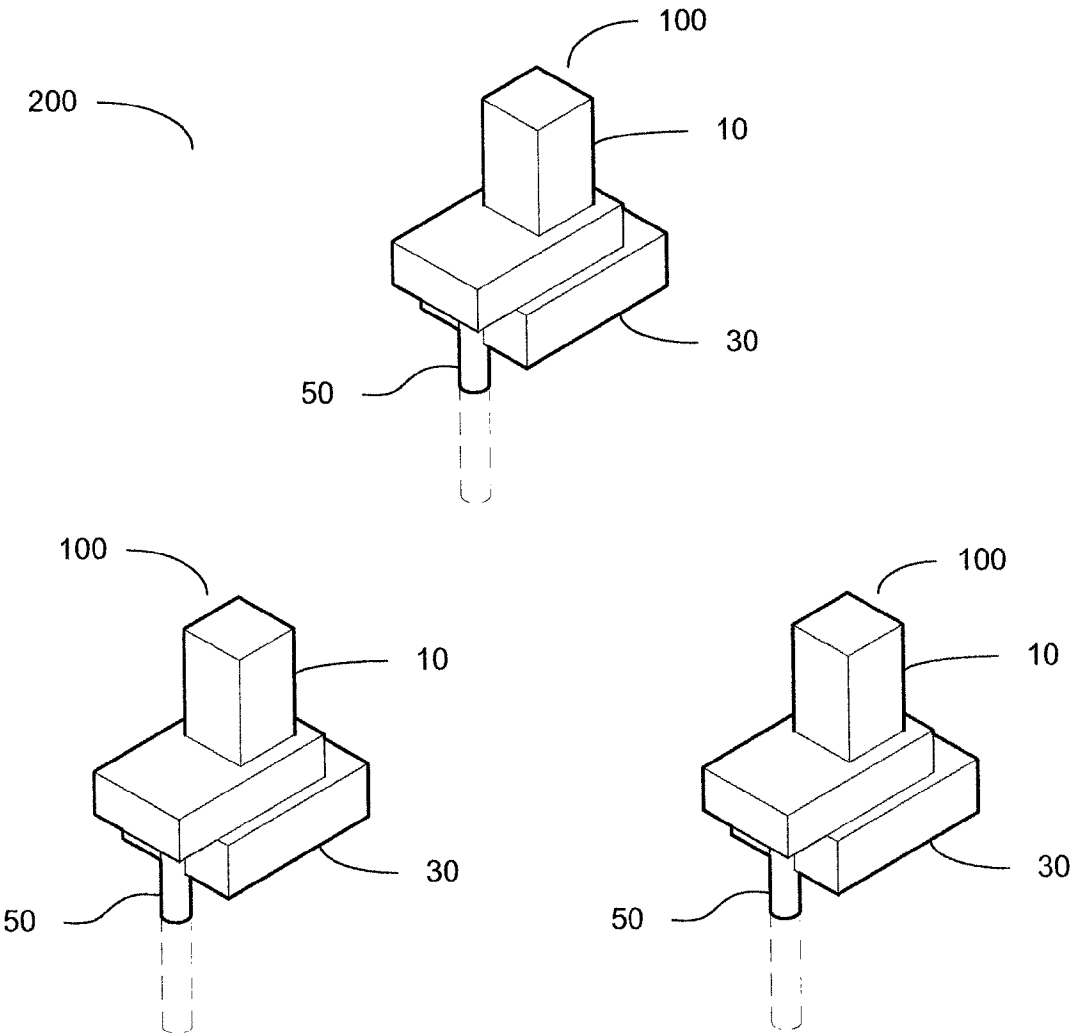
FIG. 2*b* illustrates a perspective view of an exemplary embodiment of a system for extracting and collecting volatiles from soil.

FIG. 2*b* illustrates a perspective view of an exemplary embodiment of a system for extracting and collecting volatiles from soil 200.

An exemplary embodiment may be a geometric array of at least three core tubes, which would permit the systematic progressive removal of the water. Microwave energy can be efficiently delivered with waveguides. Microwave source could remain on the rover vechicle with waveguide delivering the energy to the desired target(s). The same waveguide could transport the water vapor to a cold trap on the rover vehicle.

Retrieval, collection, and transportation of the gaseous water (or other volatile chemical) to collection chambers can utilize the same sealed microwave delivery component 20, eliminating the requirement for special water collection hardware.

What is claimed is:

1. An apparatus for extracting and collecting volatiles from regolith consisting of:

an upward stream of volatiles;

a downward stream of microwaves which propagates toward said regolith;

a collection chamber having a collection chamber aperture;

a triple-function tubular boring, delivery and transport structure having an inner tubular chamber;

wherein said triple function tubular boring, delivery and transport structure further includes a volatile release aperture on an upper half of said triple-function tubular boring, delivery and transport structure, wherein said upward stream of volatiles and said downward stream of microwaves both move through said inner tubular chamber of said boring, delivery and transport structure;

a microwave source which is configured to selectively generate said downward stream of microwaves, wherein said microwaves are within a critical frequency between 0.03 and 300 GHz and a critical wavelength of 1 millimeter to 1 meter to achieve the desired level of penetration of said regolith;

wherein said volatile release aperture is aligned with said collection chamber aperture allowing said volatile stream to enter said collection chamber;

a connecting structure which operatively couples said variable microwave source to said triple-function tubular boring, delivery and transport structure; and a volatile entry aperture on a lower portion of said triple-function tubular boring, delivery and transport structure opening to said regolith; and at least one remote sensor which measures volatile flow rate.

2. The apparatus of claim 1 wherein said at least one remote sensor is a water vapor flow detector.

3. The apparatus of claim 1 which further includes a mobility component for transporting said collection chamber.

4. The apparatus of claim 1 wherein said collection chamber is removable and may be exchanged.

5. The apparatus of claim 1 wherein said collection chamber is adapted to maintain a temperature of less than the condensation temperature of the extracted volatile.

6. The apparatus of claim 1 which is used for lunar volatile extraction and collection.

7. The apparatus of claim 1 wherein said triple-function tubular boring, delivery and transport structure is telescoping.

8. The apparatus of claim 1 wherein said microwave source generates microwaves having a wavelength ranging from 0.5 to 30 GHz.

9. The apparatus of claim 1 which further includes a coaxial cable microwave delivery component.

10. A apparatus for extracting and collecting volatiles from regolith comprised of:

at least three extraction and collection devices, each of said at least three devices comprised of:

a mobile exchange collection chamber having a collection chamber aperture;

a microwave source which is configured to selectively generate microwaves within a critical frequency between 0.03 and 300 GHz and a critical wavelength of 1 millimeter to 1 meter to achieve the desired level of penetration of regolith;

a triple-function tubular boring, delivery and transport structure;

wherein said triple-function tubular boring, delivery and transport structure further includes a volatile release aperture on an upper half of said triple-function tubular boring, delivery and transport structure opening to said cold trap;

a downward stream of microwaves which propagates toward said regolith when said variable microwave source is activated;

an upward stream of volatiles which travels toward said cold trap when said variable microwave source is activated;

wherein said volatile release aperture is aligned with said collection chamber aperture allowing said volatile stream to enter said collection chamber;

a connecting structure which operatively couples said variable microwave source to said triple-function tubular boring, delivery and transport structure; and a volatile entry aperture on a lower portion of said triple-function tubular boring, deliver and transport structure opening to said regolith;

wherein said at least three apparatuses are positioned on a surface so that the bore holes are arranged in a triangle and the region between said at least three bore holes receives concentrated heating.

11. The apparatus of claim 10 wherein at least one of said at least three apparatuses can be moved to form a new borehole forming a new triangular extraction region.

12. The apparatus of claim 10 which further includes a remote sensor that measures volatile flow.

13. The apparatus of claim 10 which further includes a mobile platform structure for mounting said microwave source, said boring component, and said collection chamber.

14. The apparatus of claim 10 which is capable of collecting volatiles selected from the group consisting of water and gasses.

15. The apparatus of claim 10 wherein said collection chamber is adapted to maintain a temperature of less than 0° Centigrade.

16. The apparatus of claim 10 wherein said collection chamber is adapted to maintain a temperature of less than the condensation temperature of the extracted volatile.

17. The apparatus of claim 10 wherein said collection chamber is adapted to maintain a temperature of less than the condensation temperature with impurities.

18. The apparatus of claim 10 wherein said microwave delivery component is a coaxial cable.

19. The apparatus of claim 10 wherein said microwave delivery component is a hollow waveguide.

* * * * *